United States Patent [19]

Apikos

[11] 4,416,788

[45] Nov. 22, 1983

[54] METAL CUTTING OIL AND METHOD FOR USING SAME

[75] Inventor: Dominic A. Apikos, Crown Point, Ind.

[73] Assignee: Atlantic Richfield Company, Philadelphia, Pa.

[21] Appl. No.: 310,359

[22] Filed: Oct. 13, 1981

[51] Int. Cl.[3] ..... C10M 1/38; C10M 1/26

[52] U.S. Cl. ..... 252/31; 252/45; 252/48.2; 252/48.4; 252/48.6; 252/48.8; 72/42

[58] Field of Search ..... 252/31, 45, 48.2, 48.4, 252/48.6, 48.8; 72/42

[56] References Cited

U.S. PATENT DOCUMENTS 2,431,010 11/1947 Zimmer ..... 252/31

2,941,945 6/1960 Fainman et al. ..... 252/31

3,130,159 4/1964 Stedt ..... 252/31

3,926,819 12/1975 Ladov ..... 252/31

*Primary Examiner*—Jacqueline V. Howard

*Attorney, Agent, or Firm*—Frank J. Uxa

[57] ABSTRACT

An improved transparent lubricating oil composition, e.g., useful as a high severity metal cutting oil, comprises a major amount of oil of lubricating viscosity; a minor, effective amount of at least one sulfur-containing compound; and a minor, effective amount of elemental sulfur. Both the sulfur-containing compound and the sulfur are present in amounts to be soluble in the composition and the combination of sulfur-containing compound and elemental sulfur is present in an amount effective to improve the extreme pressure properties of the composition.

Improved methods of metal working using such compositions are also disclosed.

24 Claims, No Drawings

METAL CUTTING OIL AND METHOD FOR USING SAME

This invention relates to lubricating oil compositions. More particularly, this invention relates to lubricating oil compositions which have improved properties for use in heavy duty applications, for example, heavy duty metal working.

Lubricating oil compositions are well known as lubricants in metal working operations. In certain heavy or severe duty applications, these compositions have traditionally been very dark and/or opaque which, in turn, limits the extent to which the operator can visually control the metal-working operation. Oil compositions which are transparent have been shown to lack the desired properties, e.g., extreme pressure properties, for use in heavy duty or severe applications.

Therefore, one of the objects of the present invention is to provide an improved lubricating oil composition.

Another object of the present invention is to provide an improved lubricating oil composition which is transparent.

A still further object of the present invention is to provide an improved method of metal working. Other objects and advantages of the present invention will become apparent hereinafter.

An improved lubricating oil composition has now been discovered. In one embodiment, the present compositions comprise a major amount by weight of oil of lubricating viscosity; a minor (by weight), effective amount of at least one added sulfur-containing compound; and a minor (by weight), effective amount of elemental sulfur. The sulfur-containing compound and elemental sulfur are each individually present in an amount which is soluble in the composition at 40° F. The combination of sulfur-containing compound and elemental sulfur is present in an amount effective to improve the extreme pressure properties of the composition. The present compositions are transparent, e.g., to allow improved visual observation of the metal working operation.

The present compositions have surprisingly been found to provide improved properties, e.g., improved extreme pressure properties, for use in heavy duty metal working, e.g., metal cutting, operations. Thus, the combination of at least one added sulfur-containing compound and elemental sulfur, in amounts which are soluble in the composition, have been found to provide substantially improved properties to the composition. These improved properties. e.g., improved extreme pressure properties, have been obtained without sacrificing the transparency of the composition. Thus, for example, the composition may be used in situations where it is important to visually observe the metal working operation.

Any suitable oil of lubricating viscosity may be employed in the present invention. However, in order to obtain the transparency of the final oil composition, the lubricating oil itself should also be transparent, e.g., at 40° F. Typical examples of the oils suitable for use in the present invention are those which are conventionally used as lubricating oils, in particular, in metal working oils. Although mineral oils are preferred, synthetic oils may be used. Suitable oils include: petroleum mineral oils, such as those refined by acid treatment, solvent extraction, hydrogenation and/or other procedures in order to achieve the desired oil quality. Although oils of widely varying viscosities may be used in the products of the present invention, it is preferred to use an oil with a viscosity of about 50 SUS to about 1000 SUS at 100° F., more preferably about 70 SUS to about 500 SUS at 100° F. Combinations of two or more different oils in a single lubricating oil composition are within the scope of the present invention. The lubricating oil comprises a major proportion, preferably at least about 65% more preferably at least about 80% by weight of the total composition.

The present invention is particularly applicable when the lubricating oil contains at least about 30% by weight, more preferably, at least about 40% by weight, of substantially paraffinic hydrocarbons.

The lubricating oil may be derived from any suitable source, e.g., conventional crude petroleum with conventional processing. Preferred oils include those containing about 30% to about 100% by weight of paraffinic hydrocarbons. More preferred oils are those containing about 30% to about 75% by weight of paraffinic hydrocarbons. These oil fractions often have a 50% distillation point of at least about 700° F. or higher and more specifically in the range of about 700° F. to about 950° F.

One particularly preferred class of lubricating oils for use in the present invention are the hydrocracked lubricating oils. The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracked lubricating oil may be subjected to additional processing, e.g. further contacting with hydrogen—again preferably in the presence of an effective catalyst—other purifying procedures and the like to further improve the quality, e.g., color of the hydrocracked lubricating oil. For example, hydrocracked lubricating oils useful in the present invention may be obtained by processes disclosed in U.S. Pat. No. 3,642,610, the specification of which is hereby incorporated by reference herein.

Any suitable sulfur-containing compound or combination of sulfur-containing compounds which is soluble in lubricating oil at 40° F. and which acts in combination with elemental sulfur to improve the extreme pressure properties of the composition may be used in the present invention. Such suitable sulfur-containing compounds may vary widely in structure and composition. It is preferred that the sulfur-containing compound or compounds used in the present compositions themselves have the capability of improving the extreme pressure properties of the compositions. One preferred class of sulfur-containing compounds are those selected from the group consisting of sulfur-containing substantially hydrocarbonaceous compounds. Substantially hydrocarbonaceous sulfur-containing hydrocarbons include, for example, mono- and di- sulfides, solfones, and sulfoxides. Preferably, the substantially hydrocarbonaceous radicals included in the sulfur-containing compounds include alkyl, alkenyl, aryl, alkaryl, alkenaryl, arylalkyl, aralkenyl and the like. Typical examples of the substantially hydrocarbonaceous radicals which may be included in the sulfur-containing compounds include alkyl such as methyl, ethyl, propyl, butyl, octyl, decyl, lauryl, stearyl and the like radicals; alkenyl such as ethenyl, propenyl, butenyl, octenyl, decenyl, oleyl, linoleyl and the like radicals; aryl such as phenyl, naphthyl and the like radicals; alkaryl such as methyl phenyl, ethyl phenyl, propyl phenyl and the like radicals; aralkyl such as phenyl methyl, phenyl ethyl, phenyl propyl and the like radicals. In each instance, these radicals may include those non-hydrocarbon substituents which do not materially interfere with the functionality of the sulfur-containing compounds in the present invention.

In one particularly preferred embodiment, the sulfur-containing compounds include about 4 to about 20 carbon atoms per molecule, more preferably about 4 to about 12 carbon atoms per molecule. In an additional preferred embodiment, the sulfur-containing compound presently useful in present compositions comprises a sulfided olefin containing about 4 to about 20, more preferably about 4 to about 12 carbon atoms per molecule.

As indicated previously, the presently useful sulfur-containing compounds are present in a minor, effective amount. Preferably, the sulfur-containing compound is present in an amount in the range of about 1% to about 20% by weight of the total composition, more preferably in the range of about 2% to about 10% by weight of the total composition. The amount of sulfur in the sulfur-containing compounds useful in the present invention preferably is in the range of about 10% to about 60%, more preferably in the range of about 20% to about 50% by weight.

These sulfur-containing compounds may be produced using various methods, e.g., conventional and well known methods.

The present compositions also include a minor, effective amount of elemental sulfur. This elemental sulfur is present in an amount which is soluble in the present compositions as indicated previously and, preferably, is itself capable of improving the extreme pressure properties of the composition. In certain instances, it is preferred to combine the lubricating oil and the elemental sulfur at elevated temperatures, more preferably in the range of about 150° F. to about 300° F., to obtain the desired solubilization of elemental sulfur in the present compositions. Preferably, the elemental sulfur is present in the present composition in an amount in the range of about 0.1% to about 1.5% by weight of the total composition, more preferably in the range of about 0.3% to about 1.0% of the total composition.

In one preferred embodiment of the present invention, the compositions of the present invention further comprise a minor (by weight), effective amount of at least one additional additive material present in an amount effective to further improve the extreme pressure properties of the composition. Any suitable, e.g., conventional and well-known, extreme pressure additive may be included in the present invention, provided that such additive material does not substantially interfere with the transparency of the present compositions. One preferred additional extreme pressure additive useful in the present invention includes those materials selected from the group consisting of halided substantially hydrocarbonaceous materials.

The halided, preferably chlorinated, hydrocarbonaceous materials suitable for use in the present invention may vary widely in structure and composition provided that the halogen, preferably chlorine, content of this material is at least about 5%, preferably at least about 40% by weight. Included among the suitable halided, preferably chlorinated, components are halided (chlorinated) paraffin, more preferably straight chain paraffin (including n-paraffin wax, kerosene and the like paraffins) of at least about 90%, still more preferably at least about 98%, linear content, halided (chlorinated) olefin and polyolefin, halided (chlorinated) aromatics including halided (chlorinated) naphthenes, halided (chlorinated) esters of fatty, naphthenic and resin acids, halided (chlorinated) microcrystalline wax and the like and mixtures thereof which contain less than about 70, more preferably about 8 to about 30 and still more preferably about 8 to about 18, carbon atoms per molecule. Of course, more than one halided (chlorinated) component may be used in a single composition and such a composition is within the scope of the present invention. It is preferred to use chlorinated n-paraffin, more preferably including chlorinated wax and kerosene (as noted above) which contain about 8 to about 30 carbon atoms per molecule, still more preferably chlorinated n-paraffin containing about 8 to about 18 carbon atoms per molecule can be used. The chlorinated components useful in the present invention may be prepared in any suitable, e.g., conventional, manner such as, for example, contacting molecular chlorine with the hydrocarbonaceous material to be chlorinated. By "hydrocarbonaceous material" is meant those materials, e.g., paraffin waxes, olefins, polyolefins, esters and the like, which are composed mainly of hydrogen and carbon and include such materials which contain, in addition, minor amounts of such constituents such as oxygen, sulfur, nitrogen, etc., which do not substantially effect their capability to improve extreme pressure properties.

The halided (chlorinated) hydrocarbonaceous component is preferably present in the range of about 0.5% to about 30% by weight of the total composition, more preferably, in the range of about 1% to about 10% by weight of the total composition.

In an additional preferred embodiment, the present compositions further comprise a minor (by weight), effective amount of at least one component, e.g., conventional and well-known component, acting to improve the lubricity of the present composition. Any of the well-known and conventional lubricity agents may be used in the present composition, provided that such inclusion does not substantially interfere with the functioning of the present compositions or the transparency of the present compositions. One particularly useful lubricity additive includes at least one ester component selected from the group consisting of:

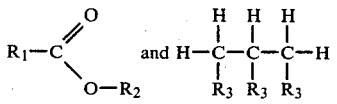

and mixtures thereof, wherein $R_1$ is a monovalent hydrocarbon radical containing about 6 to about 24 carbon atoms, preferably about 6 to about 21 carbon atoms, $R_2$ is a monovalent hydrocarbon radical containing 1 to about 21 carbon atoms, and each $R_3$ is independently selected from the group consisting of OH and

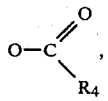

provided that at least one $R_3$ is

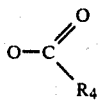

wherein $R_4$ is a monovalent hydrocarbon radical containing 1 to about 24 carbon atoms, preferably about 1 to about 21 carbon atoms, the ester component being present in an amount sufficient to improve the lubricity properties of the composition.

The suitable ester components are present in the compositions of the present invention in an amount sufficient to improve the lubricity properties of the composition. Preferably, these ester components are present in an amount of about 0.1% to about 10%, more preferably about 0.2% to about 8% and still more preferably about 0.3% to about 5%, by weight of the total composition.

Typical examples of the monovalent hydrocarbon radicals represented by $R_1$, $R_2$ and $R_4$ which are suitable include include alkyl such as methyl, ethyl, propyl, octyl, decyl, lauryl, stearyl and the like radicals; alkenyl such as ethenyl, propenyl, butenyl, octenyl, decenyl, oleyl, linoleyl and the like radicals; aryl such as phenyl, naphthyl and the like radicals; alkaryl such as methyl phenyl, ethyl phenyl, propyl phenyl and the like radicals; aralkyl such as phenyl methyl, phenyl ethyl, phenyl propyl and the like radicals. In each instance, these radicals may include those non-hydrocarbon substituents which do not materially interfere with or alter the lubricity improving properties of the ester component.

Illustrative of some applicable ester components are: degras, lanolin, sperm oil, beeswax, ester waxes, butyl stearate, ethyl lactate, methyl laurate, methyl oleate, oleyl oleate, methyl palmitate, butyl ricinoleate, methyl stearate, coconut oil, lard oil, palm oil, babassu oil, hydrogenated linseed and coconut oils and other well known vegetable and fatty oils.

Among the ester components which have been found to be of particular usefulness in the present invention are those having the following structure:

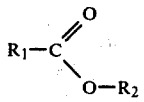

wherein $R_1$ is selected from the group consisting of alkyl and alkenyl containing from about 6 to about 21 carbon atoms and $R_2$ is selected from the group consisting of alkyl and alkenyl containing from 1 to about 21 carbon atoms. Illustrative of this class of compounds include methyl laurate, butyl laurate, methyl stearate, propenyl stearate, methyl oleate, butyl oleate, oleyl oleate and the like. Oleyl oleate has been found to be especially useful in the compositions of the present invention. In particular, when the oil of lubricating viscosity useful in the present compositions includes at least about 30% by weight of paraffinic hydrocarbons and, more particularly when such oil also includes less than about 35% by weight of non-resinous aromatic hydrocarbons (by clay gel analysis), the present ester components, more particularly, oleyl oleate, acts to increase the solubility of elemental sulfur (i.e., allows more elemental sulfur to be added and solubilized in the composition) in the present composition.

Other ingredients, such as bacteriacides, corrosion inhibitors, rust inhibitors, odor maskants, de-formants, anti-mist agents, etc. may be present in the present lubricating oil composition, for example, in minor amounts such as about 0.01% to about 10% by weight of the total composition.

The compositions of the present invention can be used by maintaining (or causing to be maintained) a lubricating amount of the composition on the metal surface being worked. These compositions can be used in metal-working operations such as cutting, grinding, boring, broaching, milling, metal shaping, drawing and the like. The compositions of the present invention are of particular usefulness when maintained on a metal surface being cut or otherwise subjected to a severe metal working operation.

The following examples illustrate more clearly the compositions of the present invention. However, these illustrations are not to be interpreted as specific limitations on the scope of the invention.

EXAMPLES 1 AND 2

Two compositions according to the present invention were prepared by blending the various components together at a slightly elevated temperature, i.e., about 200° F. to about 230° F. to insure complete solution and mixing. These compositions were as follows:

| | | COMPOSITION I Wt. % | COMPOSITION II Wt. % |
|---|---|---|---|
| Base Oil | | 88.05[1] | 87.55[2] |
| Sulfurized isobutylene[3] | | 4.25 | 4.25 |
| Elemental sulfur | | 0.50 | 0.50 |
| Chlorinated paraffin[4] | | 4.00 | 4.00 |
| Oleyl oleate | | 2.50 | — |
| No. 1 lard oil | | — | 3.00 |
| Conventional anti-mist agent[5] | | 0.70 | 0.70 |
| TYPICAL PROPERTIES OF FINAL COMPOSITION | | | |
| Viscosity | ASTMD445,cs. | 44.6 | 43.3 |
| at 100° F. | ASTMD2161,SUS | 207 | 202 |
| Color — | ASTMD1500 | <1.5 | <1.5 |
| BOTH COMPOSITIONS WERE TRANSPARENT | | | |

[1]A base stock made of a mixture of conventionally refined, petroleum derived paraffinic oils and naphthenic (pale) oil. The mixture contained about 55% by weight of parraffinic hydrocarbons and about 30% by weight of non-resinous aromatic hydrocarbons (by clay gel analysis).

[2]A base stock made of a mixture of conventionally refined, petroleum derived pale oils. The mixture contained about 40% by weight of paraffinic hydrocarbons and about 40% by weight of non-resinous aromatic hydrocarbons (by clay gel analysis).

[3]Contained about 40% by weight of combined sulfur.

[4]The chlorinated paraffin used contained about 60% by weight of combined chlorine and contained an average of about 12 carbon atoms per molecule.

[5]Each composition also included 8 ppm by weight of a conventional odor maskant.

EXAMPLES 3 TO 9

Compositions 1 and 2 were tested for effectiveness as metal cutting lubricants in the following manner which is a modified version of the Socony Mobil Tapping Method, shown on page 61 of the Lubrication Engineer's Manual, Applied Research Laboratory, United States Steel, Monroeville, Pa. (May 1966). A drill press tapper is equipped to give a measurement of the amount of torque required to work a tap down an accurately sized hole. While this work is occurring, both the tap and the hole are lubricated by the oil composition being tested. The lower the amount of torque required, the more effective the composition is as lubricant.

In order to insure adequate lubrication on both the tap and the hole, a lubricant ring oiler filled with the lubricant to be tested is fitted atop the hole. The tap passes through the lubricant bath and thus picks up a film of lubricant before entering the hole.

The following test conditions, i.e., size specifications, were used:

| | Spiral Point Tap | X-Press Tap |
|---|---|---|
| Tap Size | ½ × 13 National | Course Thread |
| I.D. of Tap Hole | 0.4220 ± 0.0005 inch | 0.4690 ± 0.0005 inch |
| Tap rpm. | 55 | 162 |

In order to show the improved metal cutting results obtained with the present compositions, e.g., Compositions 1 and 2, a series of five (5) commercially available metal cutting lubricants were also tested as noted above. A sixth commercially available metal cutting oil was used as the reference to which each of the present compositions and the other five (5) commercially available oils were compared. Results of these tests are as follows:

| Composition | Tapping Torque Test - % of Reference* | | | | | |
|---|---|---|---|---|---|---|
| | 304 Stainless Spiral Point Tap | 8620 Steel Spiral Point Tap | 8620 Steel X-Press Tap | 1117 Steel X-Press Tap | 1045 Steel Spiral Point Tap | 4340 Steel Spiral Point Tap |
| 1 (Present invention) | 98 ± 1 | 100 ± 2 | 88 ± 2.5 | 100 ± 2 | 100 ± 2 | 100 ± 1 |
| 2 (Present invention) | 98 ± 1 | 100 ± 1 | 94 ± 2 | 100 ± 1 | 100 ± 1.5 | 100 ± 1 |
| 3 (Commercially Available) | 100 ± 1 | 101 ± 1 | 102 ± 2 | 113 ± 5 | 103 ± 2 | 103 ± 1 |
| 4 (Commercially Available) | 102 ± 1 | 103 ± 1 | 112 ± 1 | 106 ± 3 | 105 ± 2 | 102 ± 2 |
| 5 (Commercially Available) | 100 ± 1 | 100 ± 2 | 103 ± 2 | 101 ± 3 | 103 ± 1 | 100 ± 3 |
| 6 (Commercially Available) | 107 ± 3 | 102 ± 1 | 130 ± 5 | 110 ± 1 | 107 ± 1 | 103 ± 1 |
| 7 (Commercially Available) | 106 ± 0.5 | 103 ± 1 | 106 ± 2 | 131 ± 1 | 109 ± 2 | 110 ± 1 |

$$*\% \text{ of Reference} = \frac{\text{IN-LB Torque of Test Oil}}{\text{IN-LB Torque of Reference Oil}} \times 100 \leftarrow \text{Low number best!}$$

By definition, Reference Oil = 100%

These data indicate that the compositions according to the present invention provide improved metal cutting lubrication relative to, for example, various commercially available lubricants. The results with regard to commercially available Compositions 6 and 7 are particularly surprising. Both Compositions 6 and 7 are indicated as being transparent and contain active elemental sulfur. However, neither of these compositions is believed to include an added sulfur-containing compound of light color, such as the sulfurized isolutylene in Compositions 1 and 2. Thus, the combination of elemental sulfur and added sulfur-containing compound of Compositions 1 and 2 provide improved metal cutting results relative to compositions, e.g., Compositions 6 and 7, which include only elemental sulfur. This is especially surprising since the level of total sulfur in Compositions 1 and 2 is about equal to the level of total sulfur in Composition 6.

While this invention has been described with respect to various specific examples and embodiments, it is to be understood that the invention is not limited thereto and that it can be variously practiced within the scope of the following claims:

The embodiments of this invention in which an exclusive property or privilege is claimed are defined as follows:

1. A lubricating oil composition comprising a major amount of mineral oil of lubricating viscosity; a minor, effective amount of at least one added sulfur-containing compound; a minor, effective amount of elemental sulfur, said sulfur-containing compound and said elemental sulfur being present each individually in an amount soluble in said composition at 40° F. and being present in combination in an amount effective to improve the extreme pressure properties of said composition and a minor, effective amount of at least one ester component to improve the lubricity of said composition and to increase the solubility of elemental sulfur in said composition, said composition being transparent.

2. The lubricating oil composition of claim 1 wherein said mineral oil of lubricating viscosity is present in an amount of at least about 65% by weight of said composition and said sulfur-containing compound comprises a sulfur-containing hydrocarbonaceous material.

3. The lubricating oil composition of claim 2 wherein said oil of lubricating oil viscosity contains at least about 30% by weight of paraffinic hydrocarbons.

4. The lubricating oil composition of claim 1 wherein said sulfur-containing compound is present in an amount in the range of about 1% to about 20% by weight of the total composition and said elemental sulfur is present in an amount in the range of about 0.1% to about 1.5% by weight of the total composition.

5. The lubricating oil composition of claim 1 which further comprises a minor, effective amount of at least one additive material present in an amount effective to further improve the extreme pressure properties of said composition, and said mineral oil of lubricating viscosity is present in an amount of at least about 65% by weight of said composition.

6. The lubricating composition of claim 5 wherein said additive material comprises a halided hydrocarbonaceous material.

7. The lubricating composition of claim 6 wherein said halided hydrocarbonaceous material is present in an amount in the range of about 0.5% to about 30% by weight of the total composition.

8. The lubricating composition of claim 2 wherein said sulfur-containing hydrocarbonaceous material includes about 10% to about 60% by weight of sulfur.

9. The lubricating composition of claim 6 wherein said halided hydrocarbonaceous material includes at least about 5% by weight of halide, calculated as elemental halogen.

10. The lubricating composition of claim 9 wherein said halide is chloride and said chlorinated hydrocarbonaceous material includes at least about 40% by weight of chlorine.

11. The composition of claim 1 wherein said ester component is selected from the group consisting of:

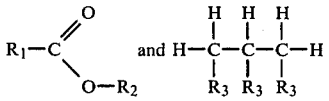

and mixtures thereof, wherein $R_1$ is a monovalent hydrocarbon radical containing about 6 to about 24 carbon atoms, $R_2$ is a monovalent hydrocarbon radical containing 1 to about 21 carbon atoms, and each $R_3$ is independently selected from the group consisting of OH and

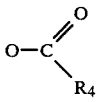

provided that at least one $R_3$ is

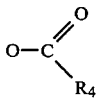

wherein $R_4$ is a monovalent hydrocarbon radical containing 1 to about 24 carbon atoms.

12. The composition of claim 11 wherein said component is an ester component selected from the group consisting of:

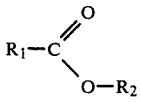

13. The composition of claim 12 wherein said ester component is present in an amount of about 0.1% to about 10% by weight of said composition.

14. The composition of claim 11 wherein wherein said ester component is present in an amount of about 0.1% to about 10% by weight of said composition.

15. The composition of claim 2 wherein said sulfur-containing compound comprises a sulfided olefin containing about 4 to about 20 carbon atoms.

16. The composition of claim 14 wherein said ester component is oleyl oleate.

17. The composition of claim 16 wherein said sulfur-containing compound comprises a sulfided olefin containing about 4 to about 20 carbon atoms.

18. In a method of metal working which involves lubricating points of contact between the work piece and the article being worked, the improvement comprising maintaining a lubricating amount of the lubricating composition of claim 1 at said points of contact.

19. In a method of metal working which involves lubricating points of contact between the work piece and the article being worked, the improvement comprising maintaining a lubricating amount of the lubricating composition of claim 2 at said points of contact.

20. In a method of metal working which involves lubricating points of contact between the work piece and the article being worked, the improvement comprising maintaining a lubricating amount of the lubricating composition of claim 4 at said points of contact.

21. In a method of metal working which involves lubricating points of contact between the work piece and the article being worked, the improvement comprising maintaining a lubricating amount of the lubricating composition of claim 10 at said points of contact.

22. In a method of metal working which involves lubricating points of contact between the work piece and the article being worked, the improvement comprising maintaining a lubricating amount of the lubricating composition of claim 12 at said points of contact.

23. In a method of metal working which involves lubricating points of contact between the work piece and the article being worked, the improvement comprising maintaining a lubricating amount of the lubricating composition of claim 14 at said points of contact.

24. In a method of metal working which involves lubricating points of contact between the work piece and the article being worked, the improvement comprising maintaining a lubricating amount of the lubricating composition of claim 17 at said points of contact.

* * * * *